US007874527B2

(12) United States Patent
Porrill et al.

(10) Patent No.: US 7,874,527 B2
(45) Date of Patent: Jan. 25, 2011

(54) FASTENING RAIL IN RAILWAY SLIDE CHAIR ASSEMBLY

(75) Inventors: John Phillip Porrill, Godalming (GB); David Ronald Seeley, Bengeo (GB); Heinz Ossberger, Grosslobming (AT); Josef Leitner, Weisskirchen (AT); Hans-Ulrich Dietze, Wusterwitz (DE); Hubertus Höhne, Butsbach (DE)

(73) Assignees: Pandrol Limited, Addlestone, Surrey (GB); VAE Eisenbahnsysteme GmbH, Zel tweg (AT); VAE GmbH, Vienna (AT); BWG GmbH & Co. KG, Butzbach (DE)

( * ) Notice: Subject to any disclaimer, the term of this patent is extended or adjusted under 35 U.S.C. 154(b) by 658 days.

(21) Appl. No.: 11/628,577

(22) PCT Filed: Jun. 10, 2005

(86) PCT No.: PCT/GB2005/002316

§ 371 (c)(1),
(2), (4) Date: Feb. 7, 2008

(87) PCT Pub. No.: WO2005/121452

PCT Pub. Date: Dec. 22, 2005

(65) Prior Publication Data

US 2008/0302881 A1 Dec. 11, 2008

(30) Foreign Application Priority Data

Jun. 11, 2004 (GB) ..... 0413093.6

(51) Int. Cl.
*E01B 7/00* (2006.01)

(52) U.S. Cl. ..... 246/453; 238/304; 238/310

(58) Field of Classification Search ..... 238/304, 238/310, 287, 349; 246/453
See application file for complete search history.

(56) References Cited

U.S. PATENT DOCUMENTS 1,863,145 A * 6/1932 Young ..... 238/331

(Continued)

FOREIGN PATENT DOCUMENTS

CA 2 144 018 A1 9/1996

(Continued)

OTHER PUBLICATIONS

Schwihag brochure for Rail Anchoring Systems for Switches, publication date unknown, system disclosed in public use more than one year before Jun. 11, 2004 priority date.

(Continued)

*Primary Examiner*—S. Joseph Morano
*Assistant Examiner*—Jason C Smith
(74) *Attorney, Agent, or Firm*—Husch Blackwell LLP Welsh Katz

(57) ABSTRACT

A rail fastening apparatus fastens an inner stock rail in a railway slide chair assembly. The apparatus includes a base plate. The base plate has on one face a rail seat region on which the inner stock rail sits when the slide chair assembly is in use. A resilient rail fastening clip restrains the inner stock rail. A locating means locates the rail fastening clip in a first position. A loading means vertically deflects the clip so as to produce a load in a toe portion of the clip. A second locating means holds the rail fastening clip in a second position different from the first position such that the toe portion of the clip sits on a ramp of the loading means in a preload condition in which the clip does not bear on the rail

18 Claims, 15 Drawing Sheets

U.S. PATENT DOCUMENTS

| | | | | | |
|---|---|---|---|---|---|
| 1,925,717 | A * | 9/1933 | Faries et al. | 238/304 |
| 1,926,088 | A * | 9/1933 | Faries et al. | 238/304 |
| 3,314,605 | A * | 4/1967 | Waters | 238/321 |
| 3,881,652 | A * | 5/1975 | Jacobson | 238/349 |
| 4,312,477 | A * | 1/1982 | Hixson | 238/304 |
| 4,350,291 | A * | 9/1982 | Dobson | 238/349 |
| 4,378,910 | A * | 4/1983 | Sonneville | 238/349 |
| 4,452,392 | A * | 6/1984 | Rajaram et al. | 238/349 |
| 4,489,885 | A * | 12/1984 | Bryan | 238/349 |
| 4,819,870 | A * | 4/1989 | Clark et al. | 238/351 |
| 4,874,128 | A * | 10/1989 | Owen | 238/355 |
| 4,921,168 | A * | 5/1990 | Heim | 238/287 |
| 4,943,006 | A * | 7/1990 | Clark et al. | 239/349 |
| 5,865,370 | A * | 2/1999 | Sonneville et al. | 238/331 |
| 5,899,417 | A * | 5/1999 | Gsodam et al. | 246/453 |
| 6,189,840 | B1 * | 2/2001 | Mantovan et al. | 246/453 |
| 6,367,704 | B1 * | 4/2002 | Mediavilla | 238/310 |
| 6,398,123 | B1 * | 6/2002 | Clisby et al. | 238/315 |
| 6,431,463 | B2 * | 8/2002 | Igwemezie | 238/264 |
| 7,185,860 | B2 * | 3/2007 | O'Brien et al. | 246/442 |
| 2002/0011526 | A1 * | 1/2002 | Igwemezie | 238/287 |
| 2008/0093472 | A1 * | 4/2008 | Hohne et al. | 238/351 |
| 2008/0302881 | A1 * | 12/2008 | Porrill et al. | 238/287 |

FOREIGN PATENT DOCUMENTS

| | | | |
|---|---|---|---|
| CA | 2162349 | A | 5/1997 |
| DE | 7238161 | U | 3/1976 |
| DE | 3207105 | A | 9/1983 |
| DE | 19724977 | A | 1/1999 |
| GB | 693585 | A | 7/1953 |
| GB | 869834 | A | 6/1961 |
| GB | 2 351 515 | A | 1/2001 |
| WO | WO 94/28245 | A | 12/1994 |

OTHER PUBLICATIONS

U.K. Search Report, dated Sep. 8, 2004, Application No. GB0413093.6.

European Patent Office (ISA), Intl. Search Report for Intl. Publ. No. WO 2005/121452 A3, Published Dec. 22, 2005, & Written Opinion of ISA.

* cited by examiner

FASTENING RAIL IN RAILWAY SLIDE CHAIR ASSEMBLY

The present application is a U.S national stage application of International Application No. PCT/GB2005/002316, filed Jun. 10, 2005, which International application was published on Dec. 22, 2005, under International Publication No. WO 2005/121452 A2. The International application claims priority of GB Patent Application No. 0413093.6 filed on Jun. 11, 2004, and this application also claims the benefit of that date.

The present invention relates to a rail fastening apparatus for fastening an inner stock rail in a railway slide chair assembly.

Slide chair assemblies are used in railway turnouts/switches. An example of a prior art slide chair assembly is shown in FIG. 1 of the accompanying drawings. In FIG. 1 a railway slide chair assembly 1 includes a baseplate 10 and an inner stock rail 2 fastened to the baseplate 10 on one side by a standard rail fastening 3 and on its opposite side, adjacent to slide chair 4, by rail fastening apparatus 5. The rail fastening apparatus 5 comprises an elongate spring clip 50 having at one end a toe portion 51 bearing on the flange of the inner stock rail 2 and at the other end a heel portion 52 for engaging locating means 53 which inhibit withdrawal of the clip 50 from the stock rail 2. The clip 50 is formed of flat bar stock bent so as to have a loop forming the toe portion 51 of the clip and two free ends 52*a*, 52*b* forming the heel portion 52 of the clip. The clip 50 is located within an opening 54 formed in a slide plate 40 on top of which a slide rail 41 sits.

Installation and removal of the clip 50 is explained below with reference to FIGS. 2A to 2H of the accompanying drawings. The spring clip 50 is inserted into the opening 54 in the slide plate 40 by pushing the clip 50 manually at an angle (see FIG. 2A). The installer then presses downwards on both ends 52*a*, 52*b* of the clip legs and pushes the spring clip 50 forwards towards the rail 2, making sure that the free ends 52*a*, 52*b* of the clip 50 are in front of setbacks formed underneath a rear abutment in the slide plate 40 (see FIG. 2B). The installer then has to employ a special installation tool 6 (see FIG. 2C) in order to install the clip 50 properly in position. Firstly (see FIG. 2D), the installer inserts an installation side 6*a* of the installation tool 6 into an installation opening 42*a* (42*b*) formed in the slide plate 40 and then (see FIG. 2E), standing behind the free end 52*a* (52*b*) of the leg of the clip 50 which is resting on the baseplate 10, lifts the leg in a levering movement onto a rear thrust abutment 43*a* (43*b*) so that the end 52*a* (52*b*) of that leg of the clip 50 rests on its rear abutment. Resting the installation tool 6 on the opposite installation opening 42*b* (42*a*), the installer must then use the installation tool 6 to lift that leg of the clip 50 over against the outer side of the rear thrust abutment 43*a* (43*b*) (see FIG. 2F). When these operations are completed the end of the other leg of the clip 50 is then positioned in a similar way. Finally, a spread head 6*b* at the opposite end of the installation tool 6 is pushed between the ends 52*a*, 52*b* of the two legs to ensure that the clip 50 is correctly seated in the housing (see FIG. 2G). In order to remove the clip 50 from the rail 2, a dismantling side 6*b* of the installation tool 6 must be inserted into the installation opening 42*b* (42*a*) of the slide plate 40 and used to prize first one leg end 52*b* (52*a*) and then the other 52*a* (52*b*) free from the rear thrust abutment 43*b* (43*a*) so that the clip 50 lies without tension on the baseplate (10) (see FIG. 2H) and can be manually removed.

It is clear that the prior art rail fastening apparatus, involving the use of a special tool and many different steps, is hard to install and also to dismantle. The example illustrated above is produced by Schwihag, but other similarly complex arrangements are also known, such as an assembly in which two separate clips are required to secure the stock rail.

Accordingly, it is desirable to provide rail fastening apparatus for fastening an inner stock rail in a railway slide chair assembly which is less complex and easier to use and does not require the use of special tools.

According to an embodiment of the present invention, there is provided a rail fastening apparatus for fastening an inner stock rail in a railway slide chair assembly, the apparatus comprising: a baseplate having on one face thereof a rail seat region on which the inner stock rail sits when the slide chair assembly is in use; a resilient rail fastening clip for restraining such an inner stock rail, the clip comprising an elongate member having at one end a toe portion for bearing on the rail and at its other end a heel portion; first locating means for locating the rail fastening clip in the apparatus in a first position, which means comprise a first abutment surface, positioned on the baseplate in a second region spaced from the rail seat region, against which surface the heel portion of the clip abuts when the apparatus is in use to inhibit withdrawal of the clip from the rail; and loading means for vertically deflecting the clip so as to produce a load in the toe portion, the loading means comprising a ramp provided adjacent to the rail seat region, whereby the clip can be installed in the apparatus by applying a driving force to the heel portion of the clip towards the rail seat region until the toe portion slides up the ramp onto the rail and the heel portion comes into contact with the first abutment surface; wherein the apparatus further comprises second locating means for locating the rail fastening clip in the apparatus in a second position, different from the first, into which the clip can be driven such that the toe portion of the clip sits on the said ramp in a pre-load condition in which the clip does not bear on the rail.

Since the clip can be installed in the apparatus simply by driving the clip with a hammer or other driving tool (either manually or mechanically) until deflected by the ramp, there is no need to provide a special installation tool as in the prior art. Moreover, it is possible to provide rail fastening apparatus embodying the invention in which the clip can be held in a pre-assembly (parked) position in which the clip does not extend over the rail seat region, thereby enabling rail fastening apparatus to be supplied to the turnout manufacturer, or railway, as a pre-assembled module. This arrangement also allows the clip to be withdrawn to a pre-assembly position to allow easy rail replacement and other required maintenance.

Preferably, the abutment surface of the first locating means is provided by a wall of a first recess provided in the upper surface of the baseplate and the second locating means comprise a second recess provided in the upper surface of the baseplate at a position further from the rail seat region than the first recess, and having a wall providing a second abutment surface, the said first and second recesses being shaped to receive the said heel portion. Each recess may have a second wall which is opposite to, and less steeply inclined than, the wall forming the said abutment surface. The shallower incline does not present the same degree of resistance to movement of the clip heel as the steeper abutment face. Preferably, each recess comprises a groove, formed directly in the face of the baseplate.

Alternatively, the first abutment surface desirably comprises a face of a projection provided on the baseplate and the second locating means comprise the said projection and a recess, provided in the clip adjacent to the said heel portion, which is shaped to receive the said projection.

A slide chair plate for receiving a slide rail is preferably provided between the said rail seat region and the said second region of the baseplate, the slide chair plate having a tunnel formed therethrough for housing the said clip, and the roof of the tunnel being such that it can bear on part of the clip when it is in use so as to assist in vertically deflecting the clip.

Alternatively, apparatus embodying the present invention may further comprise an additional such resilient rail fastening clip for restraining the inner stock rail, wherein: the first locating means comprise an additional first abutment surface provided in the second region of the baseplate at a location spaced from the other first abutment surface, against which additional first abutment surface the heel portion of the additional clip abuts when the apparatus is in use to inhibit withdrawal of the additional clip from the rail. In this case, the loading means comprise an additional ramp provided adjacent to the rail seat region, at a location spaced from the other ramp, for use in driving the additional clip onto the rail, and the second locating means are also operable to locate the additional clip in the apparatus in a second position into which the additional clip can be driven such that the toe portion of the additional clip sits on the additional ramp in a pre-load condition in which the additional clip does not bear on the rail. A slidechair plate for receiving a slide rail is provided on the baseplate between the ramps. The baseplate may be provided with clip restraining members for restraining lateral and vertical movement of the clips.

The clip is desirably formed from an elongate spring steel plate bent so as to have, proceeding from a first free end to a second free end, a toe portion having a shaped driving feature, then an intermediate portion, then a bent heel portion, and finally an end portion. The heel portion may comprise a bend in the range from 45° to 90°, preferably approximately 65°. Alternatively, the heel portion may comprise a bend greater than 90°, preferably a circular or part circular bend between 90° and 180°.

The end portion is preferably substantially straight, and its length may be selected such that it can abut the rear of the slide chair tunnel should the clip be driven towards the rail seat region beyond its installed position.

The intermediate portion of the clip may be bent so as to provide a part which abuts the roof of the tunnel, thereby aiding deflection of the clip. Preferably, the intermediate portion comprises three angled sections.

Reference will now be made, by way of example, to the accompanying drawings in which:

FIG. 7A shows a side view, FIG. 7B shows a top view, FIG. 7C shows a detail of FIG. 7A and FIG. 7D shows a perspective view of the underside of the clip;

FIG. 10 shows a further embodiment of apparatus embodying the present invention, in which

Figure 1:
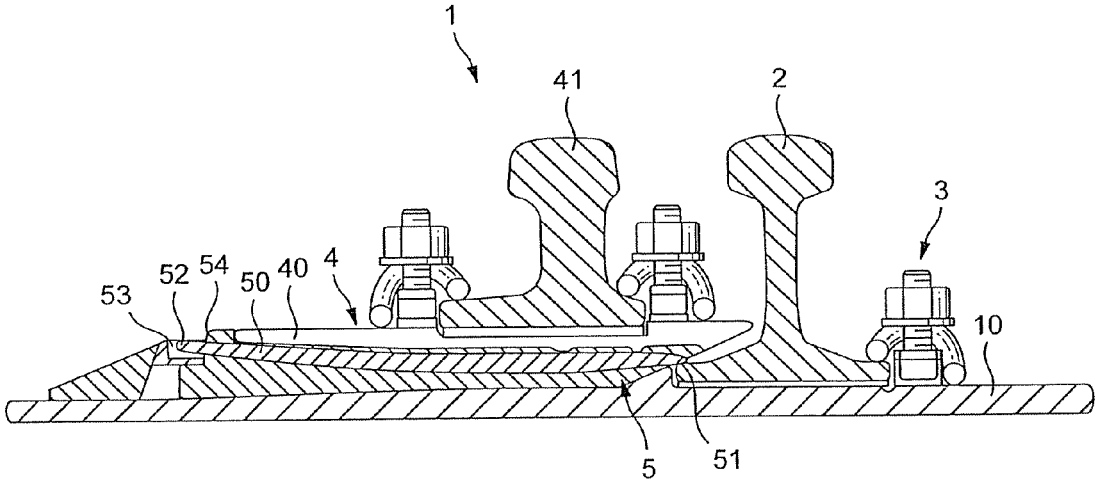
FIG. 1 PRIOR ART
FIG. 1 (described above) shows a prior art slide chair assembly.
Figure 2A:
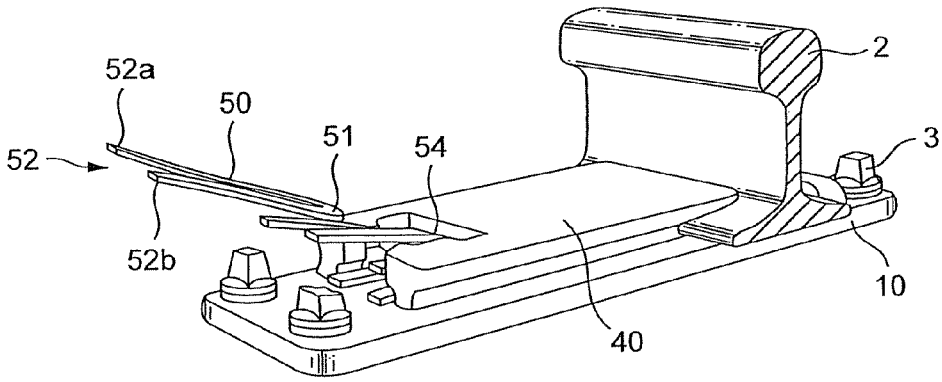
FIG. 2A PRIOR ART
FIGS. 2A to 2H (described above) show a series of views for use in explaining the assembly and dismantling of the assembly of FIG. 1.
Figure 2B:
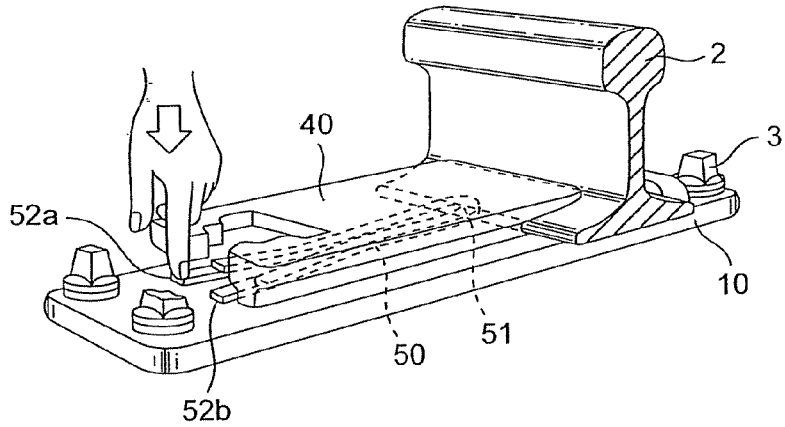
FIG. 2B PRIOR ART
Figure 2C:
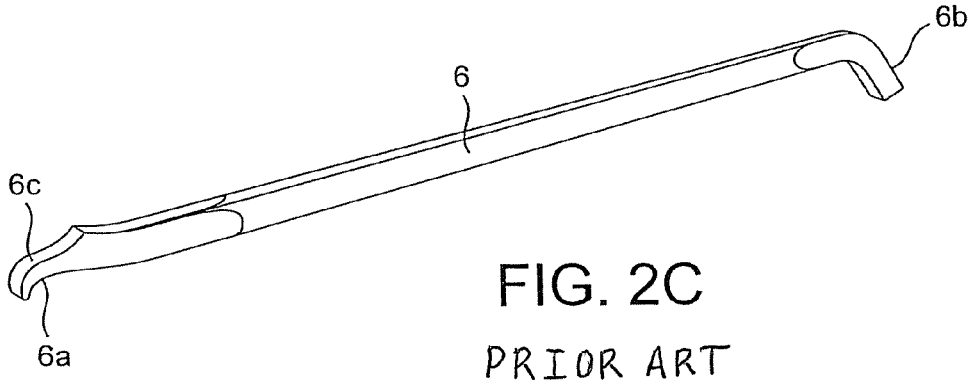
FIG. 2C PRIOR ART
Figure 2D:
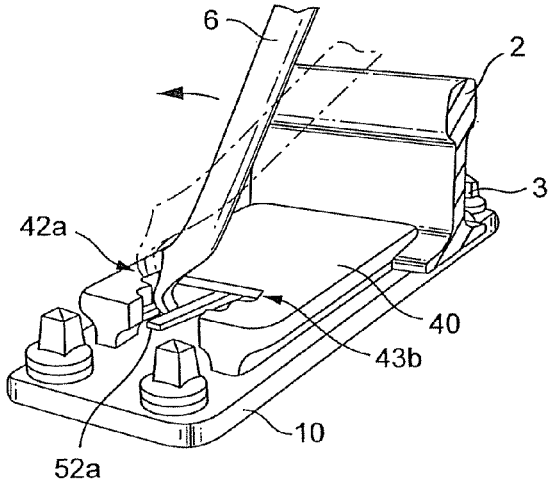
FIG. 2D PRIOR ART
Figure 2E:
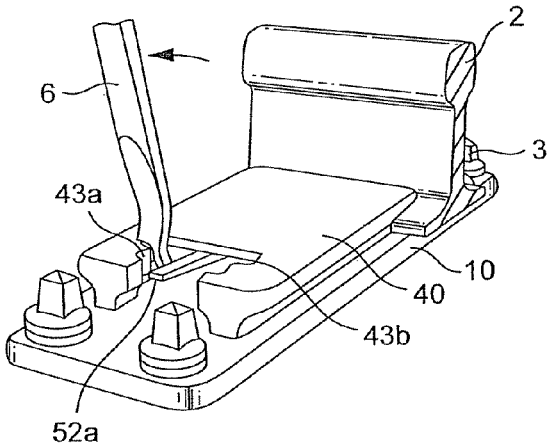
FIG. 2E PRIOR ART
Figure 2F:
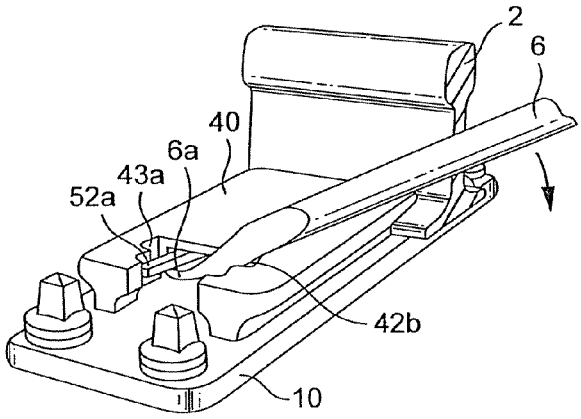
FIG. 2F PRIOR ART
Figure 2G:
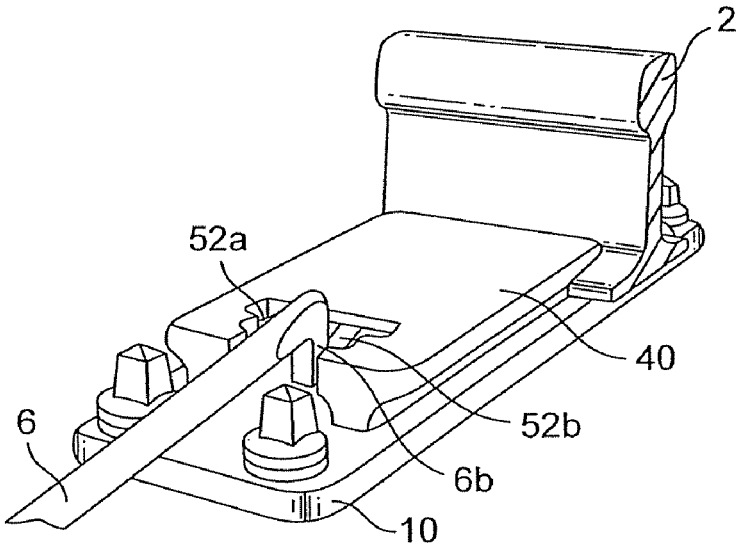
FIG. 2G PRIOR ART
Figure 2H:
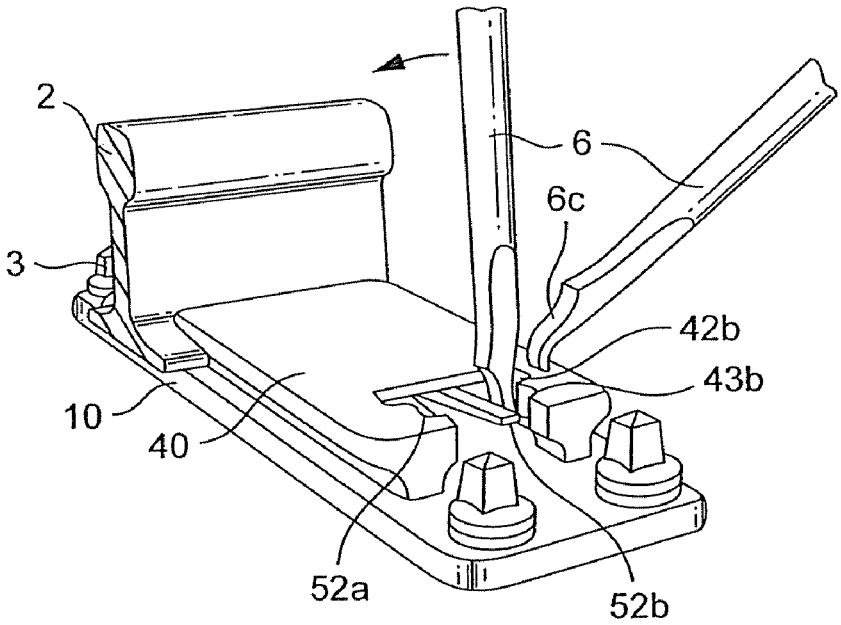
FIG. 2H PRIOR ART
Figure 3A:
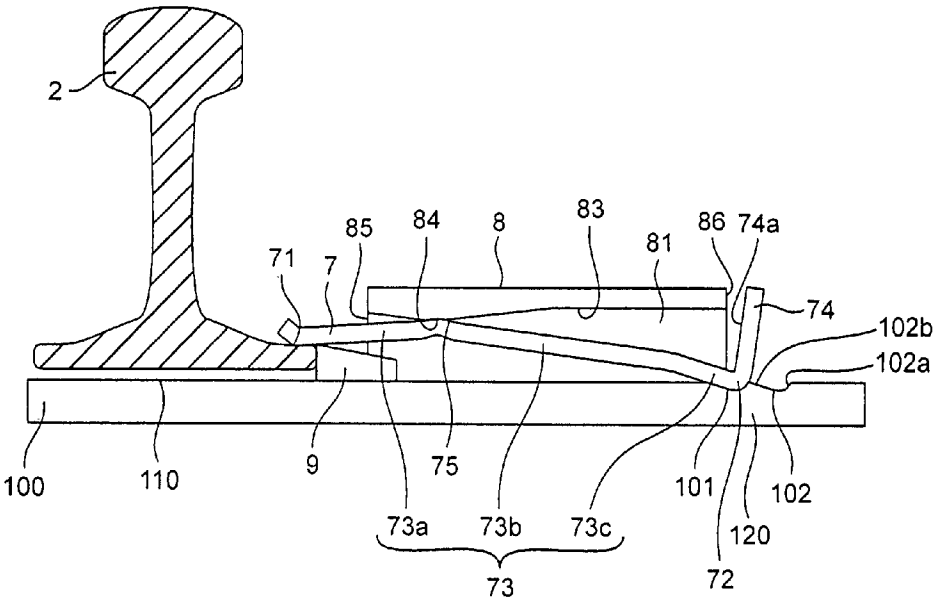
FIGS. 3A and 3B show respective side and respective sectional views of a rail fastening apparatus embodying the present invention when the clip is in its installed position.
Figure 3B:
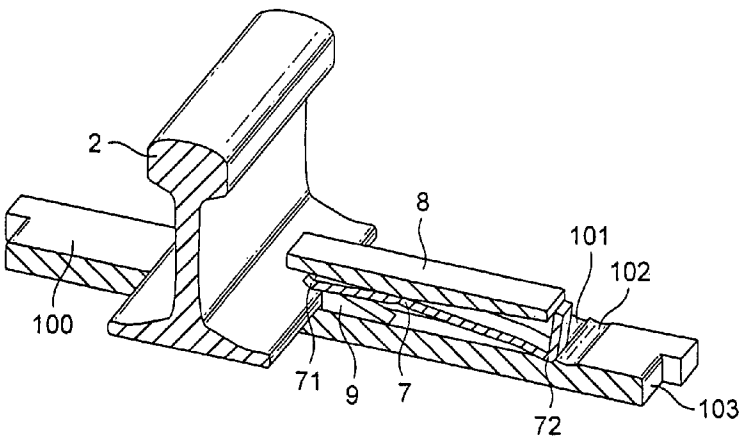
Figure 4A:
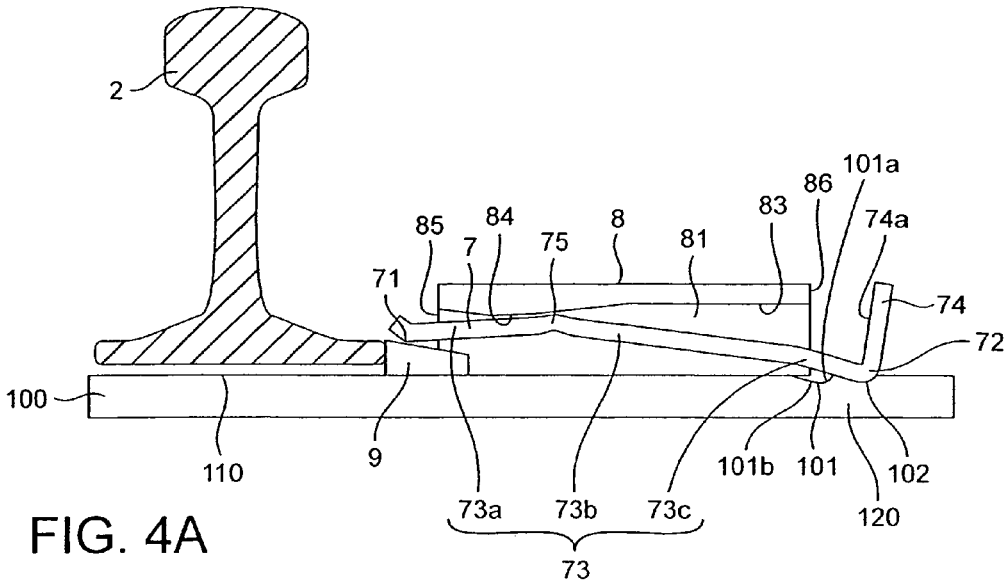
FIGS. 4A and 4B show respective side and perspective sectional views, and FIG. 4C a non-sectional perspective view, of a rail fastening apparatus embodying the present invention when the clip is in its parked position.
Figure 4B:
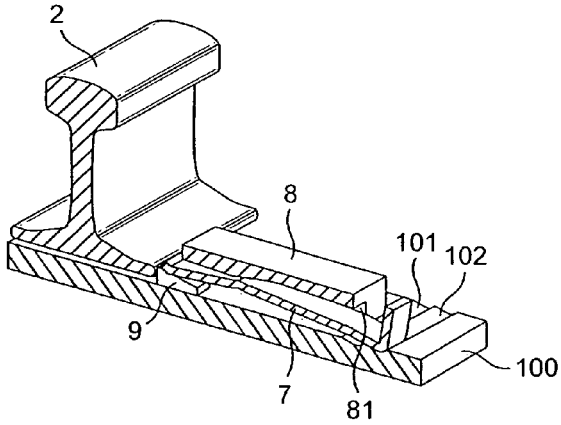
Figure 4C:
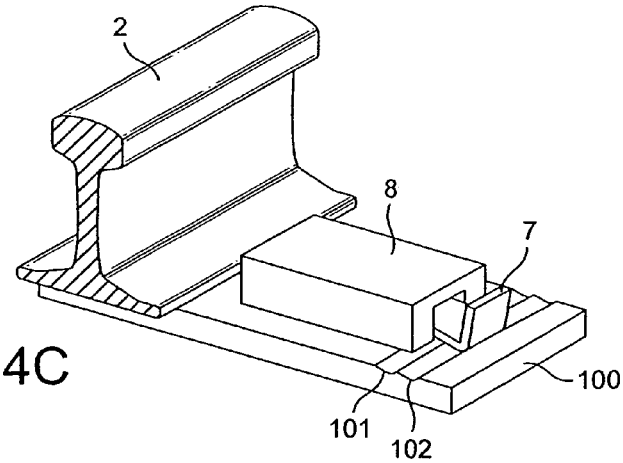
Figure 5:
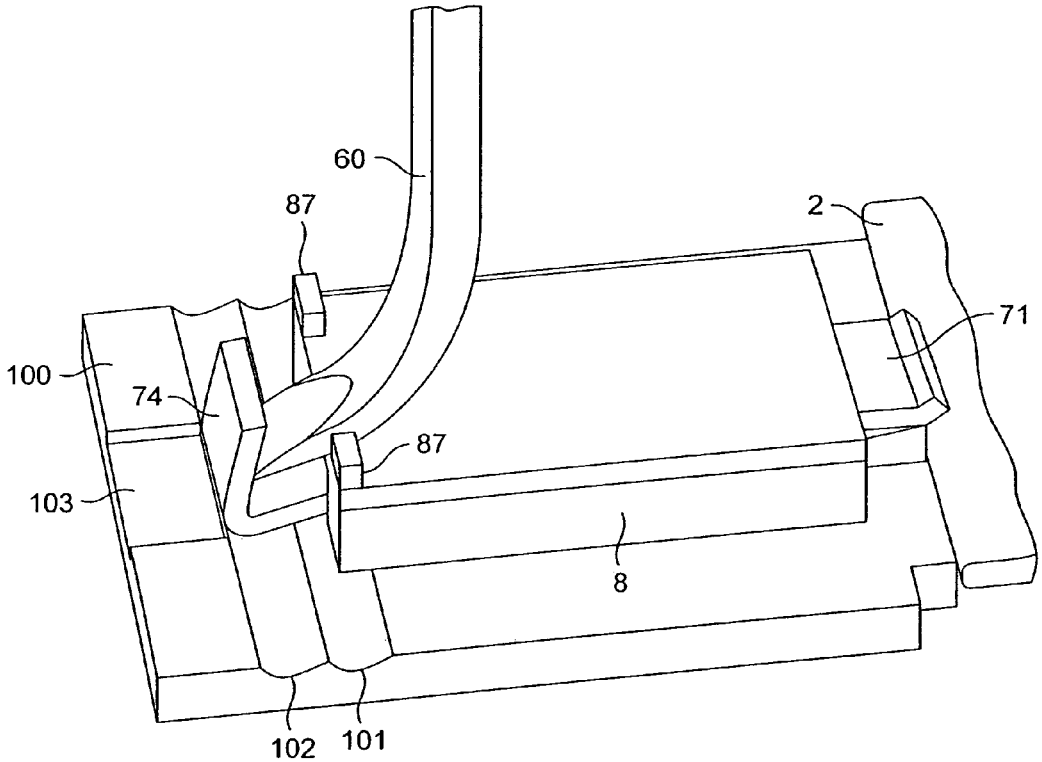
FIG. 5 shows a perspective view of rail fastening apparatus embodying the present invention illustrating removal of the clip from the rail to its parked-position.

As shown in FIGS. 3 to 5, rail fastening apparatus embodying the present invention comprises a baseplate 100 having a rail seat region 110 on which a stock rail 2 is seated when the apparatus is in use and, in a second region 120 spaced from the rail seat region 110, clip locating means comprising an installed position groove 101 and a parked position groove 102 formed in the face of the baseplate. One wall of each groove 101, 102 provides an abutment face 101*a*, 102*a*, the opposite wall 101*b*, 102*b* of each groove being less steeply inclined. Each groove 101, 102 is capable of restraining any forward or rearward movement of a resilient rail fastening clip 7 that might be induced by the tendency for the partially loaded clip to withdraw from the apparatus. Although grooves 101, 102 formed in the upper face of the baseplate 100 are illustrated, other forms of abutment face may instead be provided, for example upstands formed on the face of the baseplate (such as the raised button 104 shown on the baseplate of FIG. 8) or recesses or upstands provided by an insert joined to the baseplate. The clip 7 is elongate and is preferably formed using a single stage hot pressing process from strip spring steel. One end of the elongate clip 7 forms a toe portion 71 for bearing on the flange of a rail 2. A bend of approximately 70° is formed close to the other end of the clip 7, the bend forming a heel portion 72 of the clip 7 for engaging the grooves 101, 102 in the baseplate 100. The free end of the clip 7 adjacent to the heel portion 72 forms a substantially straight upstand 74. An intermediate portion 73 of the clip 7 between the toe portion 71 and heel portion 72 is bent so as to have three angled sections 73*a*, 73*b* and 73*c*.

The clip 7 is housed within a tunnel 81 formed through a slide chair plate 8 located on the baseplate 100 between the rail seat region 110 and the second, grooved region 120. The tunnel 81 has an opening 82 at one end adjacent to the grooves 101, 102 and at its opposite end an opening 85 adjacent to the rail seat region 110. A ramp 9 is situated partially within the opening 85 so as to abut the flange of the stock rail 2 when it is in position and serve to vertically deflect the toe portion 71 of the clip as it is driven into the tunnel 81. The slide chair plate 8 is preferably formed by casting as an integral part of the baseplate 100. Alternatively, the ramp 9 and slide chair plate 8 may be machined or forged and then welded to the baseplate 100. The end of the toe portion 71 of the clip 7 is bent upwards slightly so as to aid progress of the clip onto and up the ramp 9. The tunnel 81 has a roof 83 which is shaped internally so as to have a projection 84 adjacent to the ramp 9. When the clip approaches its installed position as shown in FIG. 3A, a bent part 75 of the clip 7 abuts the roof 83 and is deflected downwards by the projection 84. The height of the upstand 74 of the clip 7 is such that, should the clip 7 be overdriven, the upstand 74 will come into contact with a rear portion 86 of the slide chair plate 8 above the opening 82 so as to prevent further inwards movement of the clip 7.

In order to locate the clip 7 in its parked position, in which the clip does not bear on a rail 2 or overlie the rail seat region 110, the clip 7 is driven, by application of a hammer to the heel portion 72, into the tunnel 81 so that the toe portion 71 of the clip 7 is driven up the ramp 9 within the tunnel 81 until the heel portion 72 of the clip 7 comes into engagement with the first, parked position groove 102 in the face of the baseplate 100. The ramp 9 creates a clip park load by deflecting the clip through a given vertical deflection and the location of the heel portion 72 of the clip 7 in the rearmost baseplate groove 102 creates a parked position for the clip 7. In this position, the baseplate can be supplied to a turnout manufacturer, or to a railway, as a pre-assembled module. The entire process of pre-assembly is carried out with the use of a hammer and does not require a special tool.

When a rail 2 has been threaded into the assembly it can be retained on its open side by a standard rail fastener and on the slide chair side by driving the clip from the pre-assembly (parked) position to its fully installed position in which the toe portion 71 of the clip 7 bears on the flange of the rail 2. This operation is also carried out with the use of a hammer to drive the heel portion 72 of the clip out of the parked positioned groove 102 into the adjacent installed position groove 101.

As shown in FIG. 5, removal of the clip 7 from the rail 2 is carried out by inserting a lever between the rear face 86 of the slide chair plate 8 and the inner face 74*a* of the upstand 74 of the clip 7. The rear face 86 is preferably angled forward in order to facilitate the use of a standard crowbar 60 as the required lever in order to extract the clip 7 to its parked position or to fully remove the clip 7 from the assembly. As shown in FIG. 5 the crowbar or other lever 60 may be laterally restrained by the use of upstands 87 provided on the top face of the slide chair plate 8. A recess 103 is provided behind the grooves 101 and 102 to allow removal of the clip 7 by a crowbar 60.

Figure 6A:
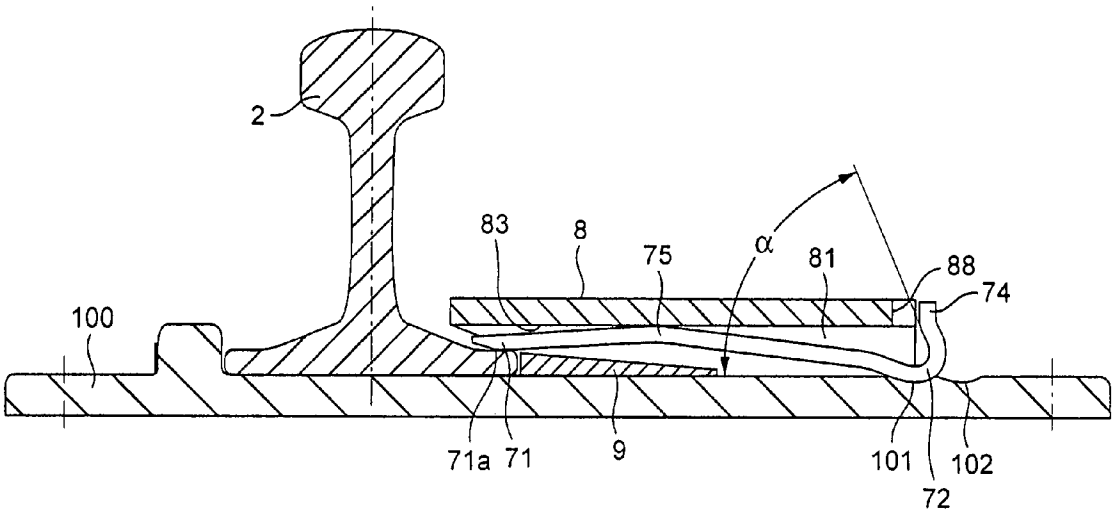
FIGS. 6A and 6B show respective sectional and plan views of another rail fastening apparatus embodying the present invention when the clip is in its installed position.
Figure 6B:
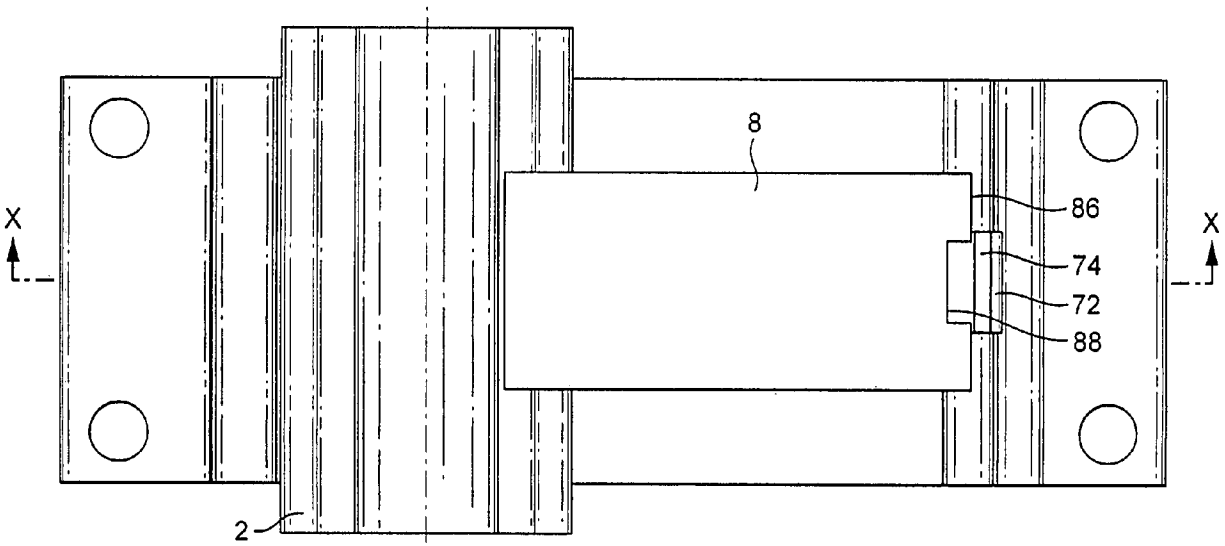
Figure 7A:
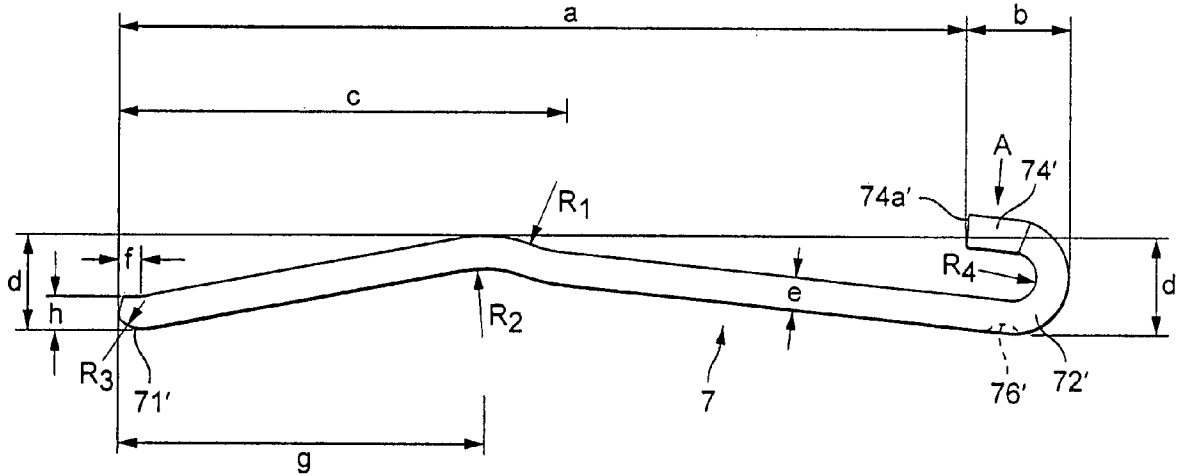
FIGS. 7A to 7D show a modified rail clip for use in an embodiment of the present invention, where
Figure 7B:
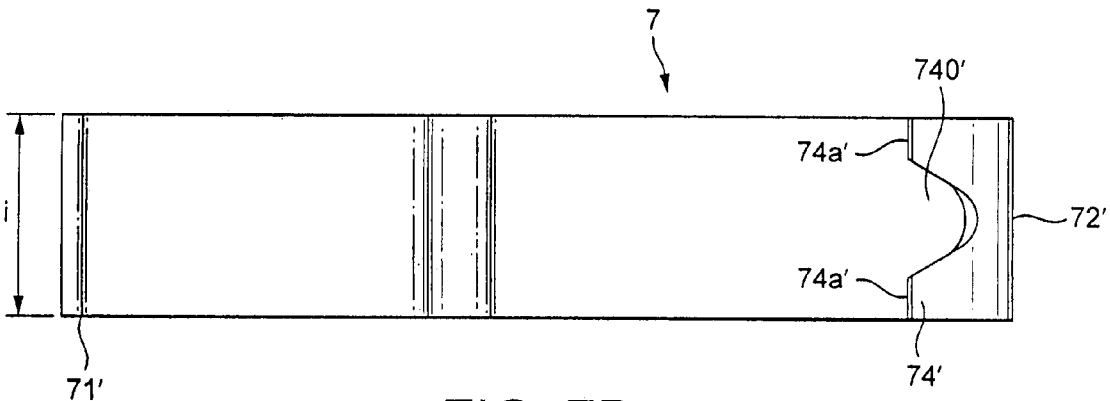
Figure 7C:
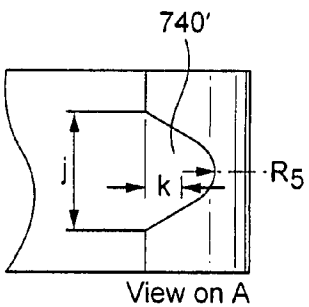
Figure 7D:
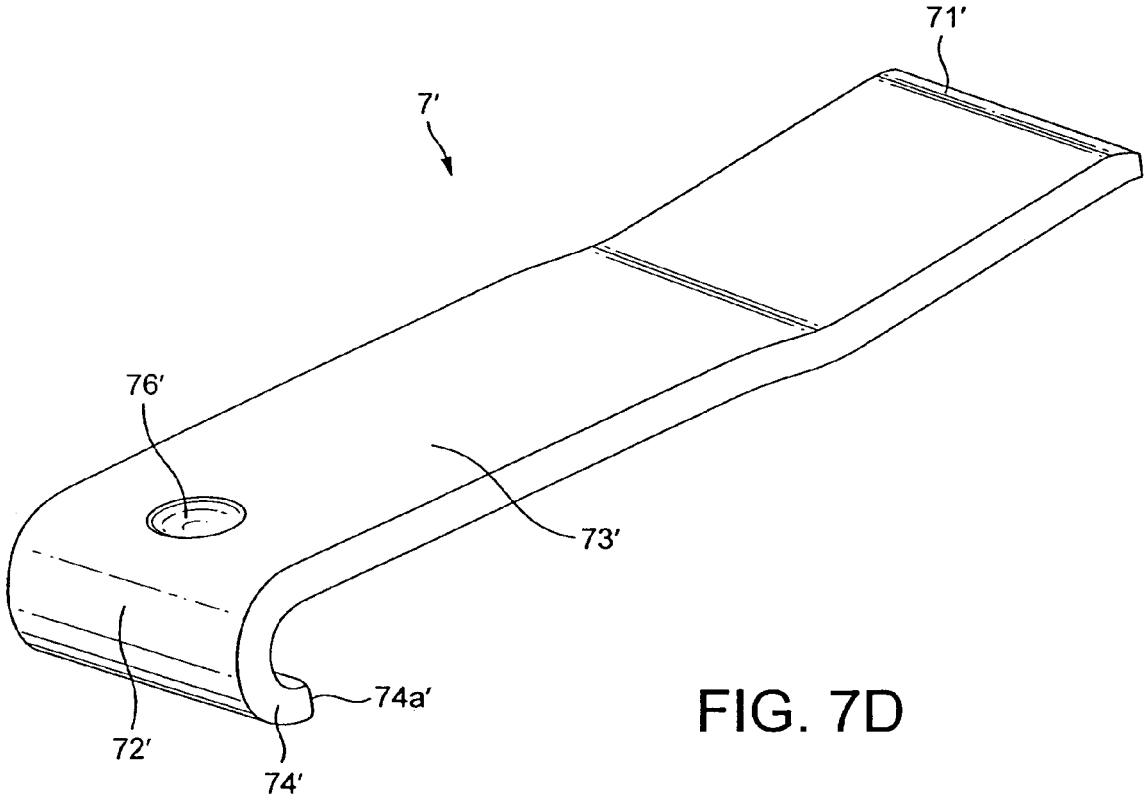

FIGS. 6A and 6B show an alternative example of rail fastening apparatus embodying the present invention. One of the ways in which the apparatus of FIG. 6 differs from that of FIG. 3A is that the roof 83 of the tunnel 81 is flat, i.e. has no projection 84. When the clip 7 approaches its installed position the bent part 75 of the clip 7 contacts the roof 83. The toe portion 71 of the clip 7 is deflected up the ramp 9 to provide the required clamping load. This simpler shape enables the tunnel to be made more easily and at less cost. It would also be possible to design the roof of the tunnel so as to be at an angle chosen in accordance with the desired clip load. The clip 7 also differs in that the toe portion 71 is longer curved but has been provided with a shaped driving feature 71*a* formed onto the clip toe 71 during the manufacturing process to allow the clip 7 to drive up the ramp 9 onto the rail foot. The heel portion 72 of the clip 7 in FIG. 6 is rounded so as to bend through an angle $\alpha$ with respect to the horizontal, where $\alpha$ is preferably approximately 65°, the clip ending in a portion 74 which is vertical with respect to the baseplate 100. The closer proximity of the clip end 74 to the rear portion 86 of the slidechair plate means that a recess 88 must be provided in the rear portion 86 to permit access for a crowbar when the clip 7 is to be withdrawn.

No special tools are required to install or extract the clip 7. Since there is a pre-assembly position for the clip 7, the baseplate 100 may be supplied as complete module ready for installation onto a sleeper. In addition, it is possible to use high-speed video techniques to inspect the condition of the assembly by the positioning of the visible end 74 of the clip 7 relative to the slide chair plate 8. There is a positive location position for the fully installed clip 7 providing good operator feedback. Furthermore, there is a wide contact point between the toe portion 71 of the clip 7 and the rail flange, reducing contact stresses on the rail 2. A single piece clip compared to the more complicated prior art arrangements makes it easier to use, faster to install and to extract. Its compact size allows a wide range of possible slide chair configurations.

Figure 9:
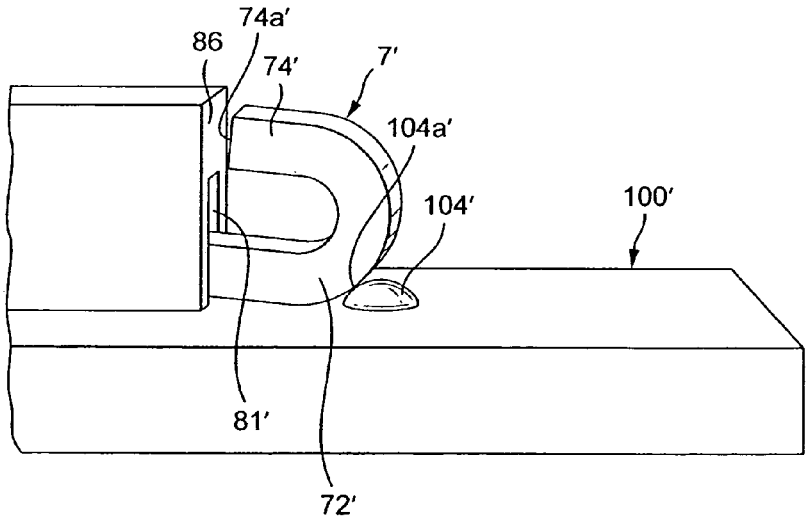
FIG. 9 shows the clip of FIG. 7 and baseplate of FIG. 8 in use in apparatus embodying the present invention.

A modified clip 71 is shown in FIG. 7. The clip of FIG. 7 differs from that of FIGS. 3 to 5 primarily in that the bend of the heel portion 72' is more pronounced, in the example shown being approximately 180°, so that (as shown in FIG. 9) an end face 74*a*' of the end portion 74' acts as a stop which contacts the rear of the slide chair 8 to prevent overdriving of the clip 7'. This design serves to reduce the overall height of the rear portion of the clip 71 and suits slide chair plate configurations of low height.

To enable a tool to be inserted between the end portion 74' and the slide chair 8 when removal of the clip 7' from the rail is required (in a similar fashion to that shown in FIG. 5), the end portion 74' of the clip 71 is bifurcated to provide a V-shaped access hole 740', the end face 74*a*' thereby being divided into two parts.

Figure 8A:
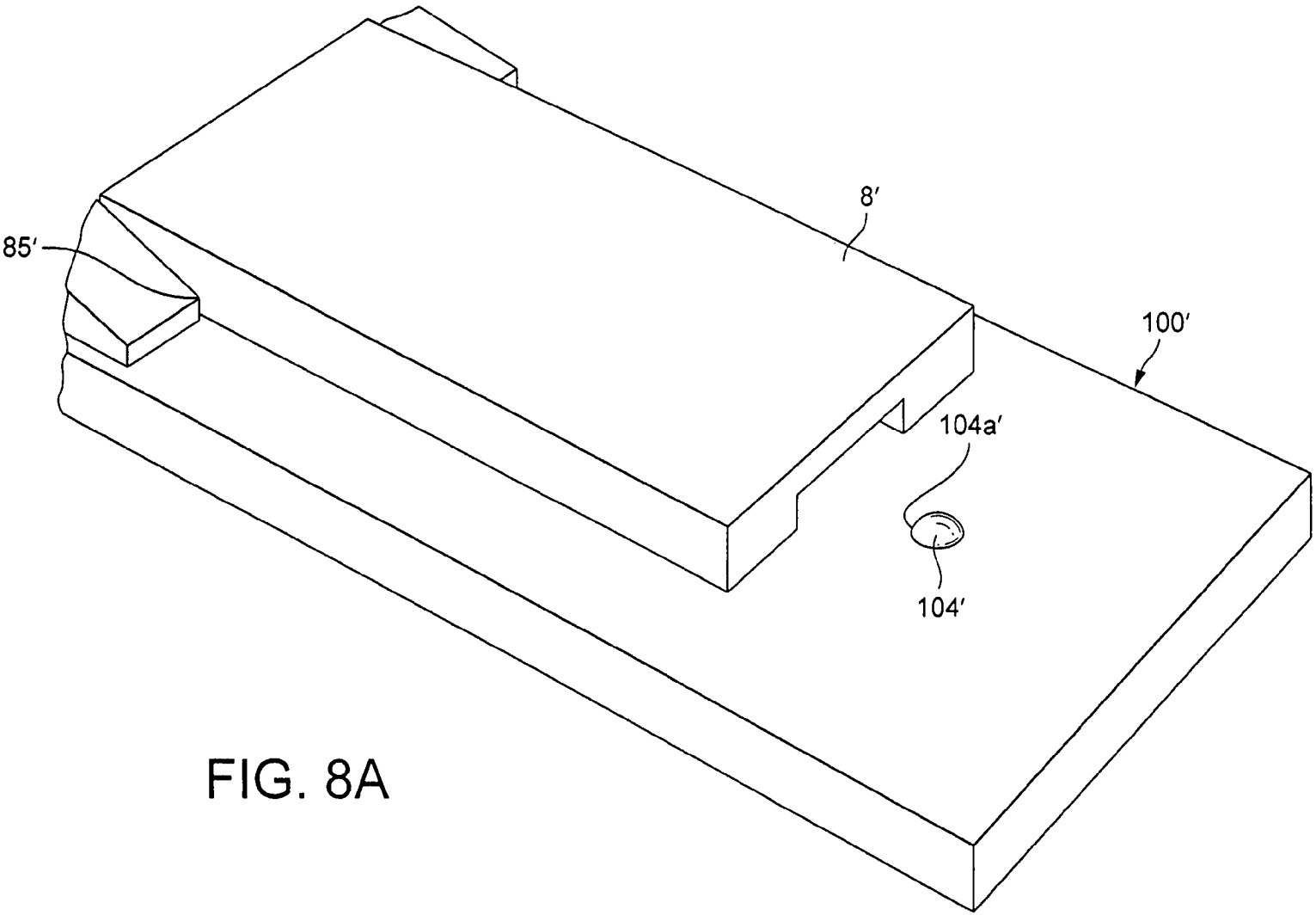
FIGS. 8A and 8B shows perspective views of a modified baseplate for use with the clip of FIG. 7.
Figure 8B:
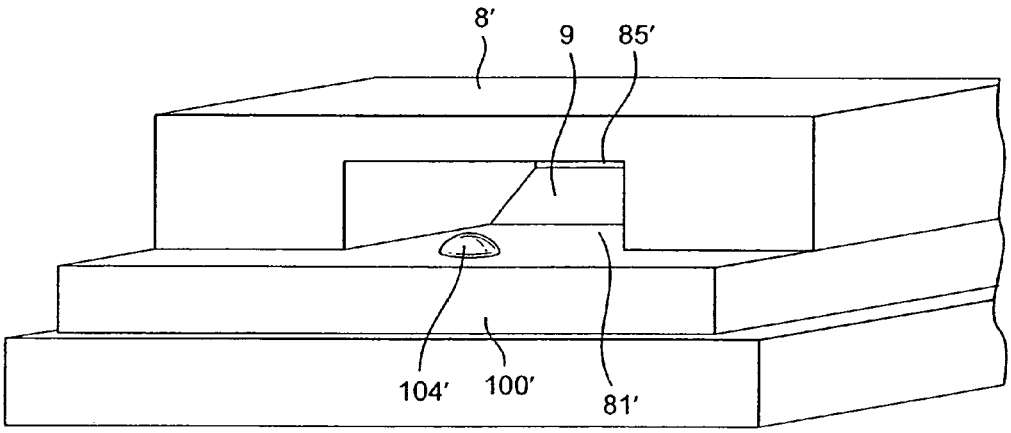

The toe portion 71' of the modified clip 71 also differs from that of the clip 7 of FIGS. 3 to 5 in that the front of the clip 7' beyond its contact point with the ramp/rail foot has been removed so as to allow the toe of the clip 7' to pass through a tunnel 81 of reduced height in a low height slide chair plate configuration (as shown in FIG. 8, for example).

By way of example, the dimensions of a clip embodying the present invention as shown in FIG. 7 may be as follows: a=213 mm, b=26 mm, c=113 mm, d=23.5 mm, e=8 mm, f=6 mm, g=92 mm, h=8 mm, i=50 mm, j=30 mm, k=10 mm, radius $R_1$ is 25 mm, radius $R_2$ is 22 mm, radius $R_3$ is 8 mm, radius $R_4$ is 6 mm and radius $R_5$ is 8 mm.

FIG. 8 shows a baseplate 100' having a modified slide chair plate 8' of low height compared to that of FIGS. 3 to 6. The end of the slide chair plate 8' adjacent to the rail seat region extends over, and makes contact with, the rail foot, so as to arrest the rail should the clip deflection exceed the design limits. The opening 85' between the roof of the tunnel through the slide chair and the rail foot being smaller than that of the opening 85 of the slide chair plate 8 of FIG. 6A.

In this embodiment, the baseplate 100' of FIG. 8 is also provided with a raised feature 104' (in this case, approximately hemispherical in shape) in place of the recesses 101, 102 used in the baseplate 100 of FIGS. 3 to 6. Like the wall 101*a* of the recess 101, the raised feature 104' provides an abutment face 104*a*, against which the heel portion 72 (72') of a clip 7(7') may abut when the clip toe bears on the rail foot, to prevent unintentional withdrawal of the clip 7(7') from the rail 2.

A clip 7,7' embodying the present invention may be provided with an indentation, formed into the underside surface of the clip just forward of the rear contact point at the clip heel, for retaining the clip in a pre-assembly (parked) position in the assembly. Such an indentation 76' is shown on the clip 7' of FIG. 7. If a clip 7,7' has such an indentation 76', the clip 7,7' may be used with a baseplate, such as but not exclusively the baseplate 100' of FIG. 8, on which a raised feature 104', shaped to fit the indentation 761, is provided. In this arrangement the clip 7,7' may be driven onto the raised feature 104', such that the indentation 76' sits on or over the feature 104', thereby locating the clip 7,7' in a pre-assembly (parked) position in which the toe portion of the clip does not bear on the rail foot and the clip is prevented from moving forwards or backwards except upon the application of a driving force.

Figure 10A:
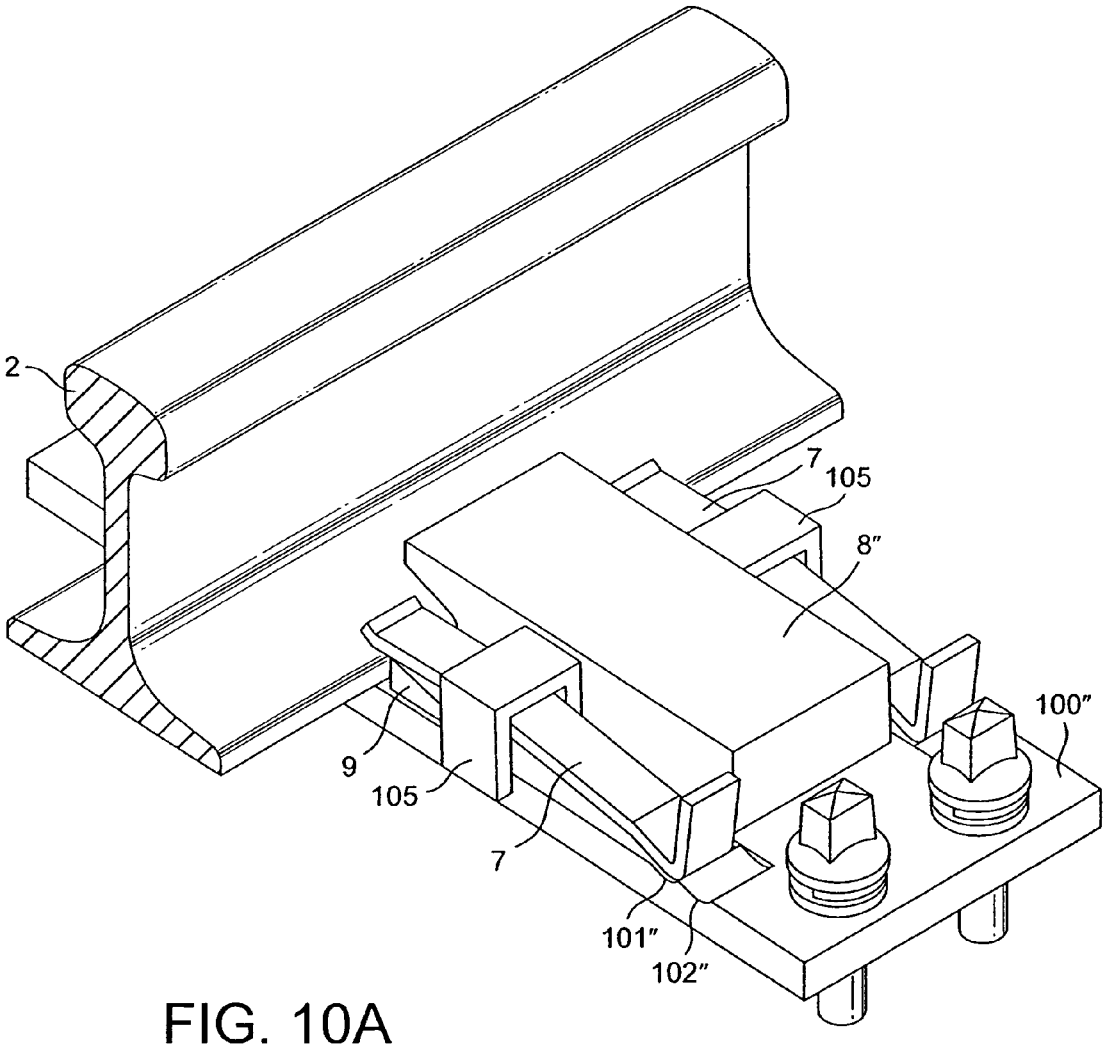
FIG. 10A shows a perspective view.
Figure 10B:
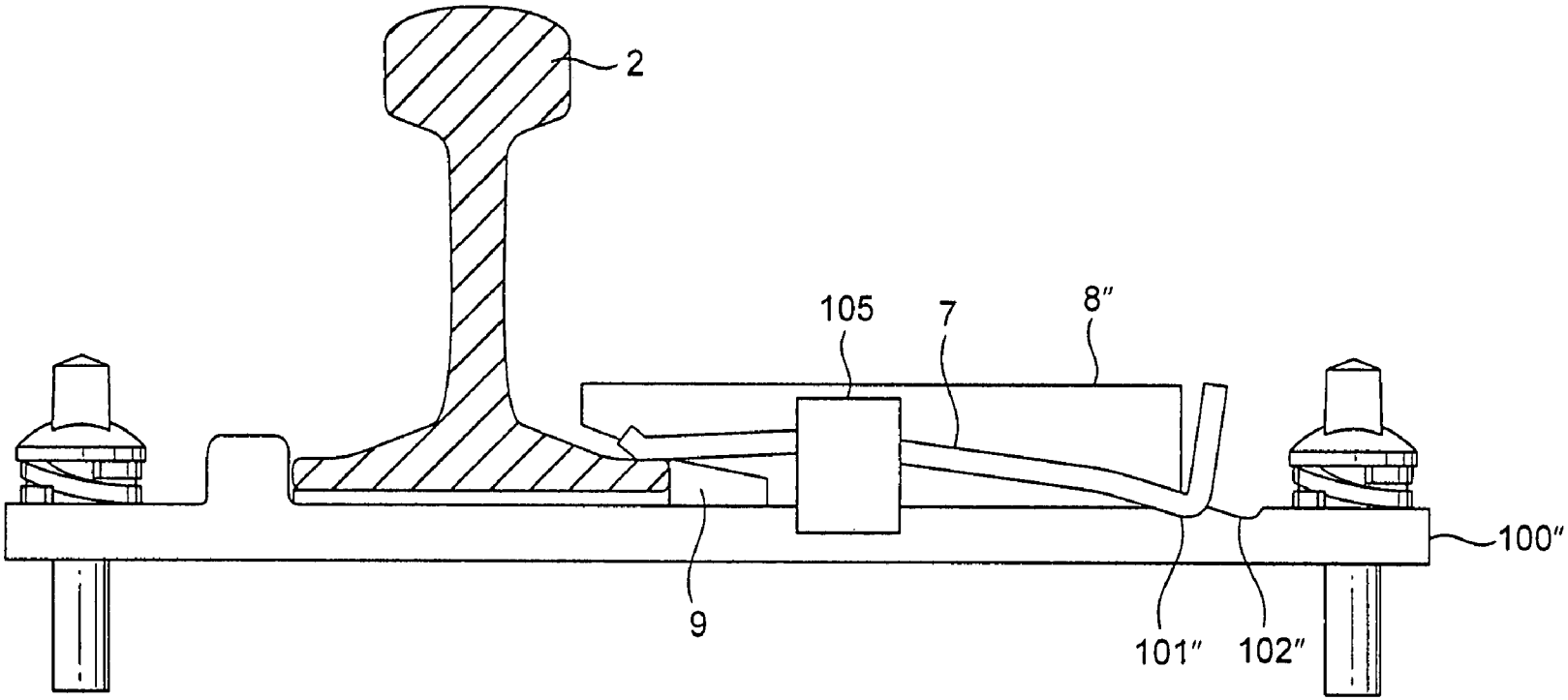
FIG. 10B shows a side view and FIG. 10C shows a plan view.
Figure 10C:
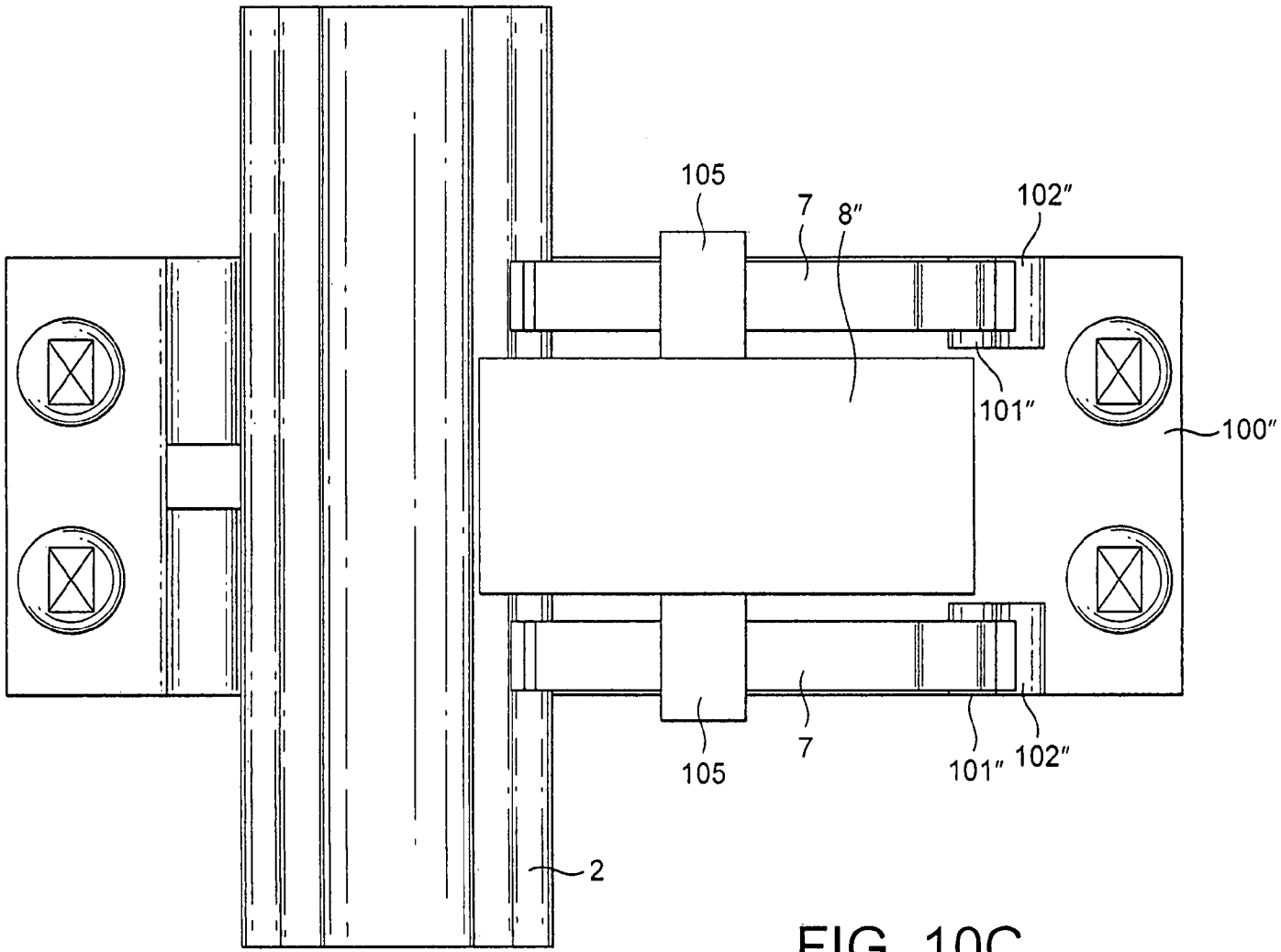

FIGS. 10A to 10C show an alternative arrangement in which two resilient rail fastening clips 7 of the type shown in FIGS. 3 to 5 are provided externally of the slidechair plate. In this example, the heel portions of the clips 7 engage grooves 101", 102" in a baseplate 100", similarly to the grooves 101, 102 in the baseplate 100 of FIGS. 3 to 5, but of course other abutment surfaces may be provided, as mentioned above. Each clip 7 is provided with a ramp 9 for use in driving the clips onto the rail. The ramps 9 and clips 7 are provided on either side of a slidechair plate 8". Slidechair plate 8" has no tunnel, unlike the plate 8 of FIGS. 3 to 5. In this embodiment, lateral and vertical movement of the clips 7 is provided by clip retaining members 105 provided on the baseplate 100". By providing the clips externally of the slidechair plate, the clips are readily visible, facilitating maintenance assessment. In addition, as the rail is held by two clips, each providing half the standard toe load of a single clip, the rail will still be retained if one of the two clips fails.

The invention claimed is:

1. A rail fastening apparatus for fastening an inner stock rail in a railway slide chair assembly, the apparatus comprising:

a baseplate having on one face thereof a rail seat region on which the inner stock rail sits when the slide chair assembly is in use;

a resilient rail fastening clip for restraining such an inner stock rail, the clip comprising an elongate member having at one end a toe portion for bearing on the rail and at its other end a heel portion;

first recess for locating the rail fastening clip in the apparatus in a first position, which means comprise a first abutment surface, positioned on the baseplate in a second region spaced from the rail seat region, against which surface the heel portion of the clip abuts when the apparatus is in use to inhibit withdrawal of the clip from the rail; and loading means for vertically deflecting the clip so as to produce a load in the toe portion, the loading means comprising a ramp provided adjacent to the rail seat region, whereby the clip can be installed in the apparatus by applying a driving force to the heel portion of the clip towards the rail seat region until the toe portion slides up the ramp onto the rail and the heel portion comes into contact with the first abutment surface;

wherein the apparatus further comprises second recess for holding the rail fastening clip in the apparatus in a second position, different from the first, into which the clip can be driven such that the toe portion of the clip sits on the said ramp in a pre-load condition in which the clip does not bear on the rail.

2. Apparatus as claimed in claim 1, wherein the abutment surface of the first recess is provided by a wall in the upper surface of the baseplate and the second recess provided in the upper surface of the baseplate at a position further from the rail seat region than the first recess, and having a wall providing a second abutment surface, the said first and second recesses being shaped to receive the said heel portion.

3. Apparatus as claimed in claim 2, wherein each recess has a second wall which is opposite to, and less steeply inclined than, the wall forming the said abutment surface.

4. Apparatus as claimed in claim 2, wherein each recess comprises a groove.

5. Apparatus as claimed in claim 1, wherein the first abutment surface comprises a face of a projection provided on the baseplate and the second recess comprise the said projection, provided in the clip adjacent to the said heel portion, which is shaped to receive the said projection.

6. Apparatus as claimed in claim 1, wherein a slide chair plate for receiving a slide rail is provided between the said rail seat region and the said second region of the baseplate, the slide chair plate having a tunnel formed therethrough for housing the said clip, and the roof of the tunnel being such that it can bear on part of the clip when it is in use so as to assist in vertically deflecting the clip.

7. Apparatus as claimed in claim 1, further comprising an additional such resilient rail fastening clip for restraining the inner stock rail, wherein:

the first locating means comprise an additional first abutment surface provided in the second region of the baseplate at a location spaced from the first abutment surface against which additional first abutment surface the heel portion of the additional clip abuts when the apparatus is in use to inhibit withdrawal of the additional clip from the rail;

the loading means comprise an additional ramp provided adjacent to the rail seat region, at a location spaced from the ramp for use in driving the additional clip onto the rail; and the second locating means are also operable to locate the additional clip in the apparatus in a second position into which the additional clip can be driven such that the toe portion of the additional clip sits on the additional ramp in a pre-load condition in which the additional clip does not bear on the rail.

8. Apparatus as claimed in claim 7, wherein a slide chair plate for receiving a slide rail is provided on the baseplate between the ramps.

9. Apparatus as claimed in claim 7, wherein the baseplate is provided with clip restraining members for restraining lateral and vertical movement of the clips.

10. Apparatus as claimed in claim 1, wherein the clip is formed from an elongate spring steel plate bent so as to have, proceeding from a first free end to a second free end, a toe portion including a shaped driving feature, then an intermediate portion, then a bent heel portion, and finally an end portion.

11. Apparatus as claimed in claim 10, wherein the heel portion comprises a bend in the range from 45° to 90°.

12. Apparatus as claimed in claim 11, wherein the bend is approximately 65°.

13. Apparatus as claimed in claim 10, wherein the heel portion comprises a bend greater than 90°.

14. Apparatus as claimed in claim 13, wherein the bend is approximately a circular or part circular bend between 90° and 180°.

15. Apparatus as claimed in claim 10, wherein the end portion is substantially straight.

16. Apparatus as claimed in claim 10, wherein the height of the end portion is selected such that it can abut the end face of the said slide chair plate should the clip be driven towards the rail seat region beyond its installed position.

17. Apparatus as claimed in claim 10, wherein the intermediate portion of the clip is bent so as to provide a part which abuts the roof of the tunnel.

18. Apparatus as claimed in claim 17, wherein the intermediate portion comprises three angled sections.

* * * * *